US005624069A

United States Patent [19]

Coats et al.

[11] Patent Number: 5,624,069

[45] Date of Patent: Apr. 29, 1997

[54] INTERNATIONAL DOCUMENT SHIPPING POUCH

[75] Inventors: Garry R. Coats, Dallas; Marci S. Hayes, Fort Worth, both of Tex.

[73] Assignee: Moore Business Forms, Inc., Grand Island, N.Y.

[21] Appl. No.: 542,383

[22] Filed: Oct. 12, 1995

[51] Int. Cl.[6] ..... B65D 27/08

[52] U.S. Cl. ..... 229/74; 229/72

[58] Field of Search ..... 229/69, 72, 74

[56] References Cited

U.S. PATENT DOCUMENTS

| | | | |
|---|---|---|---|
| 886,350 | 5/1908 | Corliss | 229/72 |
| 1,401,399 | 12/1921 | Gaspar . | |
| 1,598,983 | 9/1926 | Olm | 229/72 |
| 2,318,997 | 5/1943 | Hopkins . | |
| 2,843,310 | 7/1958 | Hopkins | 229/72 |
| 3,199,769 | 8/1965 | Hillman, II et al. . | |
| 3,355,090 | 11/1967 | Werby . | |
| 4,129,214 | 12/1978 | Gendron . | |
| 4,317,538 | 3/1982 | Alter et al. . | |
| 4,535,930 | 8/1985 | Ward . | |
| 4,682,793 | 7/1987 | Walz | 229/69 X |
| 4,852,795 | 8/1989 | Volk, Jr. | 229/72 X |
| 5,044,669 | 9/1991 | Berry | 229/74 X |
| 5,336,541 | 8/1994 | Kobayashi . | |
| 5,397,052 | 3/1995 | Walz | 229/74 X |

FOREIGN PATENT DOCUMENTS

| | | |
|---|---|---|
| 2450204 | 9/1980 | France . |
| 2683795 | 6/1993 | France . |
| 3238053 | 4/1984 | Germany . |
| 4109862 | 10/1992 | Germany . |
| 1149044 | 4/1969 | United Kingdom . |

*Primary Examiner*—Jes F. Pascua
*Attorney, Agent, or Firm*—Nixon & Vanderhye P.C.

[57] ABSTRACT

A shipping envelope assembly includes first and second envelopes having aligned open sides and connected together by a perforation. The second envelope is smaller and may be folded up to cover part of a first, printed face of the first envelope, and adhesively secured to it. The back of the first envelope has alternating strips of pressure sensitive adhesive and release material, and is covered by a plurality of rectangular labels having intermeshing strips of adhesive and release material. When the rectangular labels are removed from the back of the first envelope they are applied to the sides of a shipping carton, while the back of the first envelope is applied to the top of the carton, with destination indicia readily readable.

22 Claims, 5 Drawing Sheets

INTERNATIONAL DOCUMENT SHIPPING POUCH

BACKGROUND AND SUMMARY OF THE INVENTION

Particularly in the international shipment of documents and packages, special considerations exist for handling of the documents especially where different documents might be delivered to different international cities by a single aircraft. Presently the documents are shipped in the cockpit of an airplane and time is often lost in gathering the documents, sorting them for individual shipments, and the like. Also documents are sometimes misplaced when handled in this manner. Therefore the inventors have recognized a need for an envelope assembly, and/or package, which allow presorting and easy identification of international documents. These international documents may be attached directly to each individual package being shipped, with easy access for removal of the documents at a gateway city, as well as for ready deliverability to the final destination city.

The need identified by the inventors is fulfilled according to the present invention by providing a unique combination of envelopes and adhesive. Typically two envelopes are constructed which are detachably connected to each other, one for carrying documents that are removed at a gateway city, while the other contains documents for a final destination city. At least the documents for the final destination city may be adhesively secured to a package to which they relate, and adhesive for securing them to a package covered by strips which may also function to clearly identify the package as an international document shipment.

According to one aspect of the present invention a shipping envelope assembly is provided comprising the following components: A first envelope having a first, open side allowing insertion of documents therein, a second side substantially parallel to the first side, and third and fourth sides substantially perpendicular to the first and second sides, and first and second faces. A second envelope having a first, open side allowing insertion of documents therein, a second side substantially parallel to the first side, and third and fourth sides substantially perpendicular to the first and second sides, and first and second faces. The first and second envelopes having a connection along a cooperating side of each, connecting the envelopes together. A line of weakness (e.g. perforation) formed at the connection of the first and second envelopes. A first manually activatable adhesive pattern provided on at least one of the first and second envelopes first face for securing the second envelope first face to the first envelope first face when the second envelope is folded with respect to the first envelope along the line of weakness. And, a second manually activatable adhesive pattern provided on the second face of the first envelope for attachment of the first envelope to a package.

Typically the cooperating sides of the first and second envelopes provide a connection between them which comprises the third side of the first envelope and the fourth side of the second envelope, and the first side of each of the envelopes are substantially aligned with each other.

The second manually activatable adhesive pattern preferably comprises a first pressure sensitive adhesive coating covering a significant portion of the first envelope second face, and at least one release strip having first and second faces, and covering the first adhesive coating with a second face of the at least one release strip in contact with the second face of the first envelope. The at least one release strip includes a second pressure sensitive adhesive coating covering a significant portion of the first face and further comprises indicia printed on the first face of the at least one release strip. The second face of the first envelope and the first face of the at least one release strip preferably comprise alternating and intermeshing bands of pressure sensitive adhesive and adhesive release material, such as shown in U.S. Pat. No. 5,336,541 (the disclosure of which is hereby incorporated by reference herein). Preferably a plurality of release strips are provided, each dimensioned to fit on a face of a package to which the first envelope second face is applied.

The first manually activatable adhesive pattern may comprise a pattern of pressure sensitive adhesive disposed on the second envelope first face adjacent the third side of the second envelope, and covered by a release strip, or may comprise rewettable adhesive. Destination indicia is typically imaged on the second face of the second envelope. Typically the second envelope is dimensioned so that the distance between the third and fourth sides thereof is about 30–70% (typically about 50%) of the distance between the third and fourth sides of the first envelope, so that when the second envelope is folded about the line of weakness (such as a perforation line) to bring the first pattern of adhesive into contact with the first face of the first envelope, an uncovered portion of the first face of the first envelope is provided. Destination indicia is imaged on the uncovered portion of the first face of the first envelope, such as final destination city indicia, whereas gateway city indicia is imaged on the second face of the second envelope.

Typically a continuous envelope flap is provided at the first side of each of the first and second envelopes, and a third manually activatable adhesive pattern is formed on the flap to allow sealing of the flap to close the open first sides of the envelopes. The first manually activatable adhesive pattern may comprise a pattern of pressure sensitive adhesive disposed on the second envelope first face adjacent the third side of the second envelope, and covered by a release strip.

According to another aspect of the present invention a shipping envelope assembly is provided comprising the following components: A first envelope having a first, open side allowing insertion of documents therein, a second side substantially parallel to the first side, and third and fourth sides substantially perpendicular to the first and second sides, and first and second faces. A second envelope having a first, open side allowing insertion of documents therein, a second side substantially parallel to the first side, and third and fourth sides substantially perpendicular to the first and second sides, and first and second faces. The first and second envelopes having a connection along a cooperating side of each, connecting the envelopes together. A first manually activatable adhesive pattern provided on at least one of the first and second envelopes first face for securing the second envelope first face to the first envelope first face when the second envelope is folded with respect to the first envelope along the line of weakness. And, a second manually activatable adhesive pattern provided on the second face of the first envelope for attachment of the first envelope to a package. And, wherein the cooperating sides of the first and second envelopes providing a connection therebetween comprises the third side of the first envelope and said fourth side of the second envelope; and wherein the first side of each of the envelopes are substantially aligned with each other. The details of the constructions of the envelopes are preferably as set forth above.

According to yet another aspect of the present invention a package assembly is provided comprising the following components: A substantially rectangular parallelepiped (e.g. cardboard) box having six faces, including top and bottom faces and four side faces. An envelope having a first face with destination indicia imaged thereon and a second face with alternating strips or bands of pressure sensitive adhesive and release material, the second face pressure sensitive adhesive adhered to the top face of the box, and second envelope including documents therein. And, four rectangular labels each having a first face with indicia imaged thereon and a second face with alternating strips of pressure sensitive adhesive and release material, the second face pressure sensitive adhesive of each of the labels adhered to one of the side faces of the box.

The envelope in the package described above typically comprises a first envelope, and the assembly also includes a second envelope smaller than the first envelope having first and second faces, the first and second envelopes connected together by a line of weakness at a common side edge thereof and by adhesive at a first position spaced from the common side edge so that the envelope first faces are in face-to-face engagement with each other and so that the destination indicia on the first envelope first face is uncovered by the second envelope. The second envelope also contains documents within it. Destination indicia is also imaged on the second envelope second face, e.g. gateway city indicia while on the first face of the first envelope final destination city indicia is imaged.

It is the primary object of the present invention to provide a simple yet effective assembly for the appropriate transportation of international documents and packages. This and other objects of the invention will become clear from an inspection of the detailed description of the invention and from the appended claims.

DETAILED DESCRIPTION OF THE DRAWINGS

Figure 1:
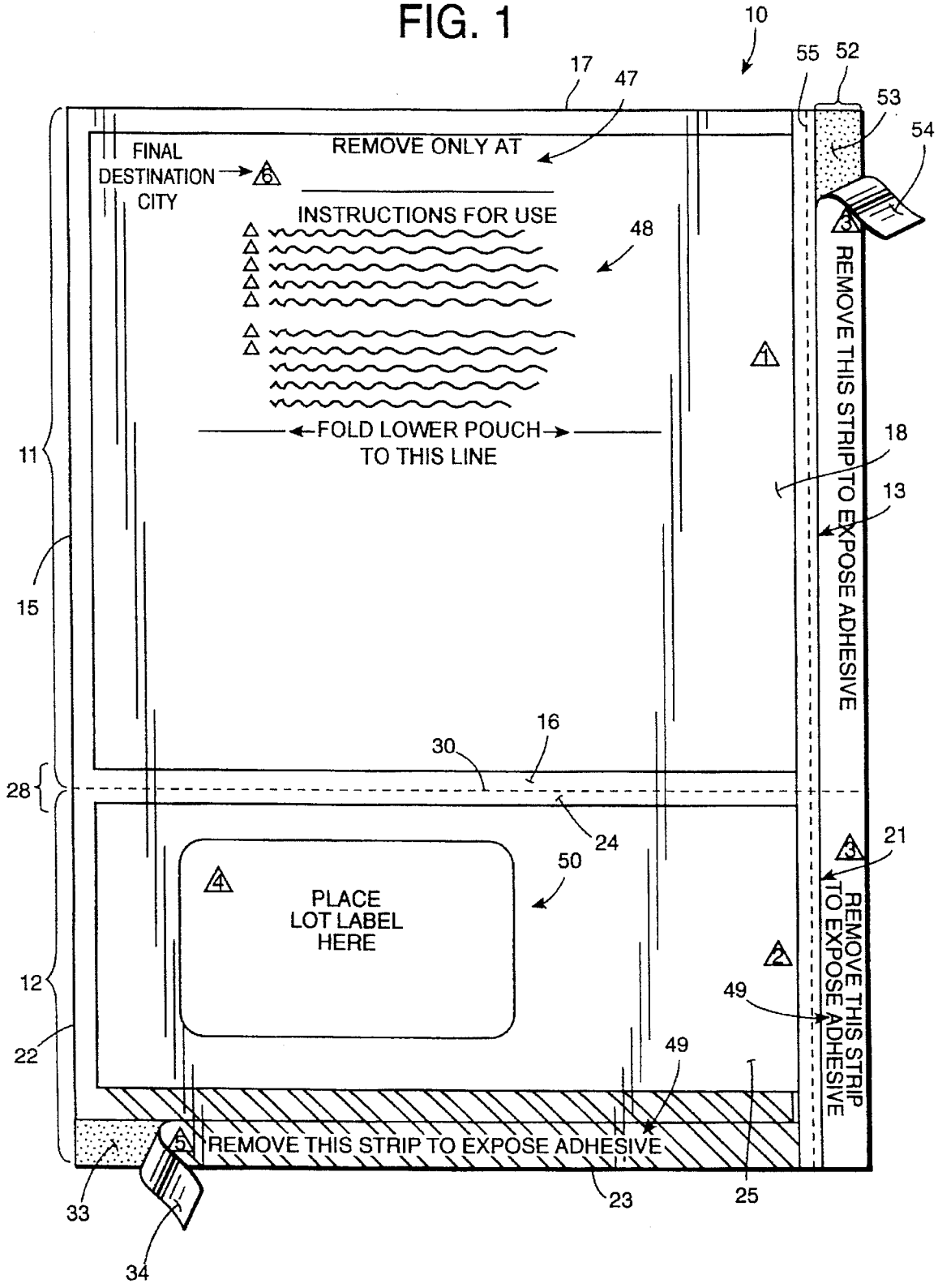
FIG. 1 is a top plan view of an envelope assembly according to the present invention before documents are inserted therein and it is attached to a package.

An exemplary shipping envelope assembly according to the present invention is seen in FIGS. 1 through 4 prior to use thereof. The assembly, shown generally by reference numeral 10, includes a first envelope 11, and a second envelope 12. The first envelope 11 has a first, open side 13 (seen most clearly in FIGS. 3 and 4) allowing insertion of documents therein, such as documents 14 illustrated schematically in FIG. 4. The first envelope 11 also includes a second side 15 (see FIGS. 1 and 2) substantially parallel to the first side 13, and third and fourth sides 16, 17 substantially perpendicular to the sides 13, 15. Preferably the sides 15–17 are closed permanently, although under some circumstances they can be made so that they are closed by the end user. The first envelope 11 also comprises a first face 18 (see FIG. 1) and a second face 19 (see FIG. 2).

Figure 2:
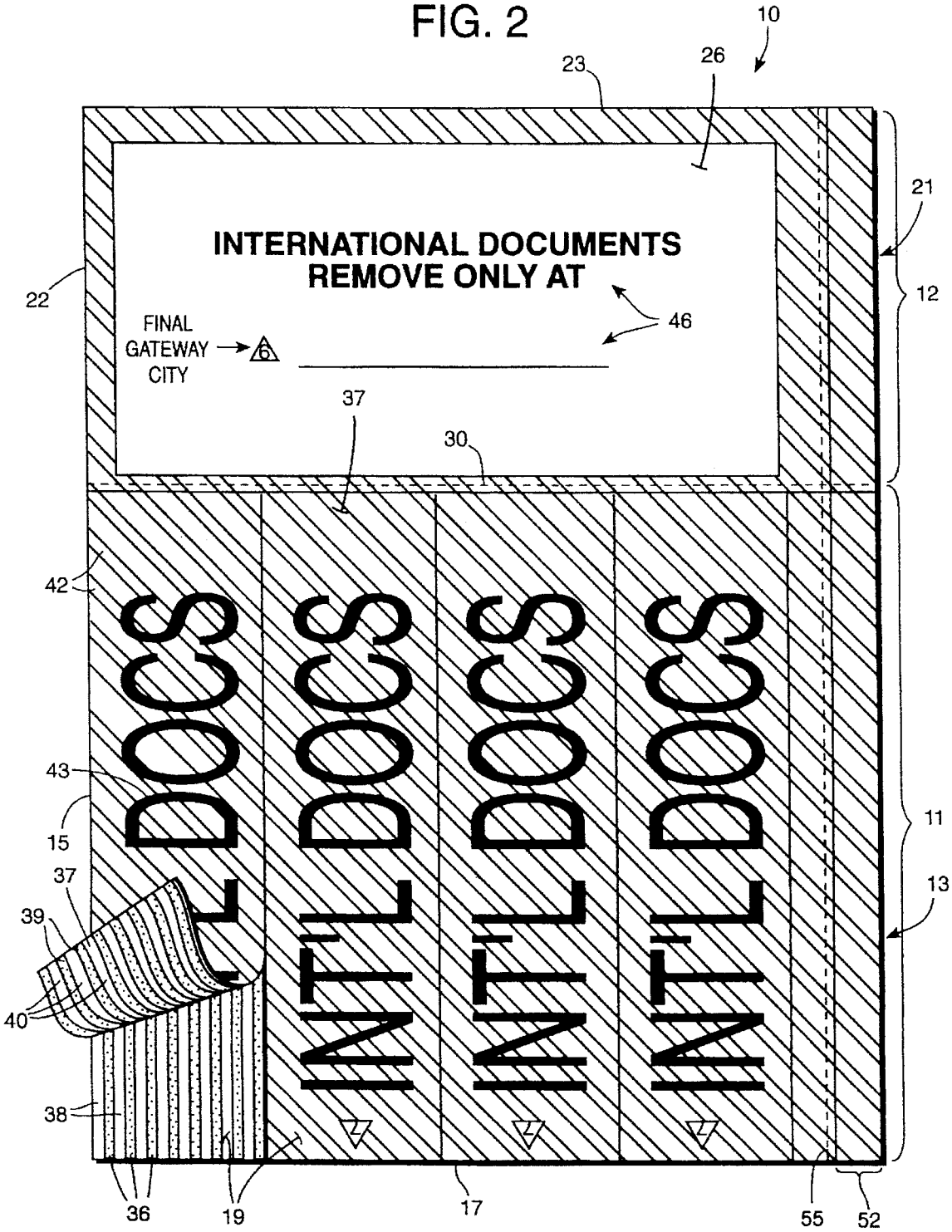
FIG. 2 is a bottom view of the assembly of FIG. 1, and showing one of the strips covering the second face of the first envelope of the assembly being removed.
Figure 3:
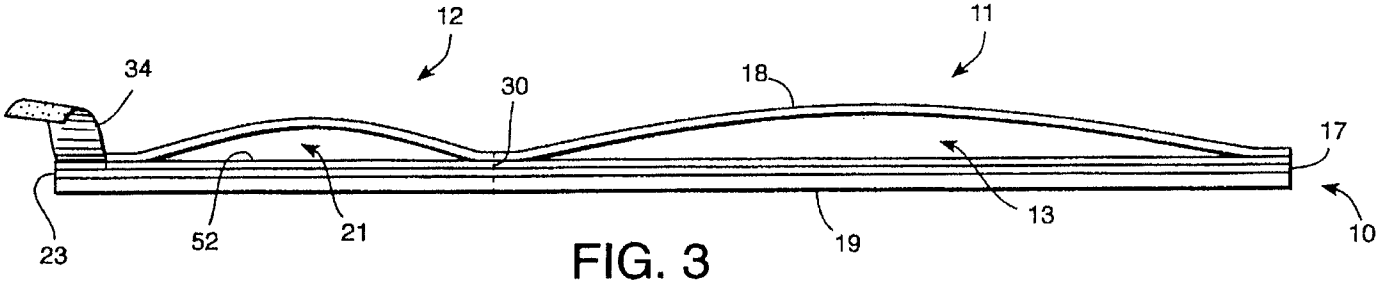
FIG. 3 is an end schematic view of the open sides of the envelope assembly of FIGS. 1 and 2, and showing a release strip associated with the second envelope being removed.

The second envelope 12 also has a first, open side 21 (see FIGS. 3 and 4 in particular) allowing insertion of documents of 22 (see FIG. 4) therein, the open sides 13, 21 preferably aligned as clearly illustrated in FIGS. 1 through 4. The second envelope 12 also comprises a second side 22 substantially parallel to the first side 21, and third and fourth sides 23, 24 (see FIG. 1) substantially perpendicular to the sides 21, 22. The second envelope 12 also includes a first face 25 (FIG. 1) and a second face 26 (FIG. 2). The sides 22 through 24 are preferably closed permanently, although one or more of them can be made so that they are closed by the end user.

As seen in FIGS. 1 through 4, a connection is preferably provided between the envelopes 11, 12, with the sides 13, 21 aligned, as well as the sides 15, 22 aligned. The connection is provided—as indicated generally by reference numeral 28 in FIG. 1—at the third side 16 of the first envelope 11 and the fourth side 24 of the second envelope 12. Preferably a lane of weakness—such as the perforation line 30 seen in all of FIGS. 1 through 4—is provided at the connection between the envelopes 11, 12, to allow the envelopes 11, 12 to be folded with respect to each other thereabout (e.g. so that the first faces 18, 25 thereof are in face-to-face engagement), and also preferably to facilitate separation of the envelopes 11, 12 when specifically desired.

Note that the dimension of the second envelope 12 between the third and fourth sides 23, 24 thereof is less than the dimension of the first envelope 11 between the third and fourth sides 16, 17 thereof. Typically this dimension of the second envelope 12 is about half of that of the first envelope 11, but in the more general case is about 30–70%, so that when the second envelope 12 is folded about the line of weakness 30 to bring the faces 18, 25 into substantially face-to-face engagement, an uncovered portion 31 (see FIG. 5) of the first face 18 of the first envelope 11 is provided having a size sufficient for readily readable indicia (47) to be seen thereon.

Figure 5:
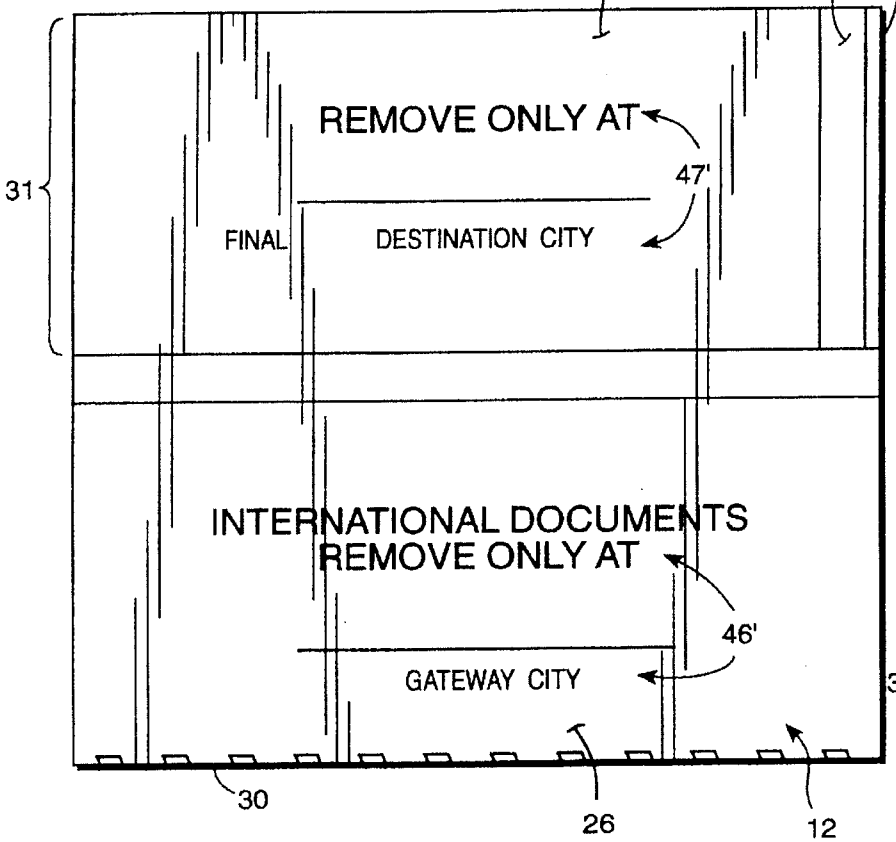
FIG. 5 is a top plan view of the envelope assembly of FIG. 1 once the documents have been inserted into the envelopes, the second envelope pivoted to a position partially overlying the first envelope.

The envelope assembly 10 further comprises a first manually activatable adhesive pattern provided on at least one of the first and second envelopes first face (that is either or both 18/25) for securing the faces 18/25 in face-to-face engagement when folded about the fold line 30 (again as seen in FIG. 5). The first manually activatable adhesive pattern in the preferred embodiment illustrated in the drawings comprises a pressure sensitive adhesive strip 33 formed on the face 25 adjacent the third side 23 of the envelope 12, and covered by a release strip 34. While a strip 33 of pressure sensitive adhesive is illustrated, other configurations may also be provided such as other patterns (continuous or discontinuous) of pressure sensitive adhesive, or rewettable or another type of manually activated adhesive with or without a covering strip (such as the release strip 34).

Figure 8:
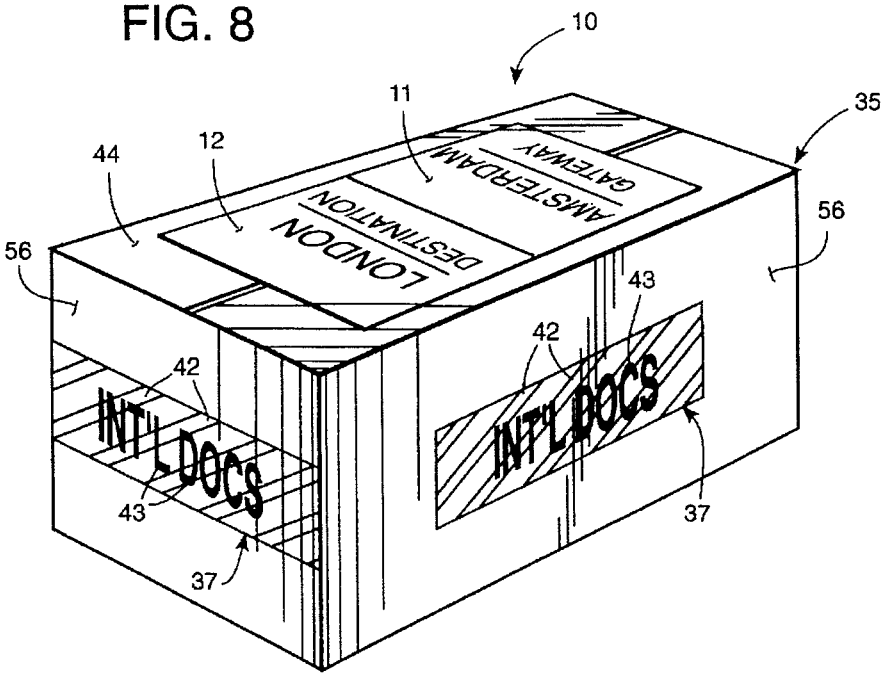
FIG. 8 is a schematic top perspective view of a package according to the invention to which the components of the envelope assembly of FIGS. 5 and 6 have been applied.

The assembly 10 also comprises a second manually activated adhesive pattern provided on the second face 19 of the first envelope 11 for attachment of the first envelope 11 to a package (e.g. the cardboard box 35 seen in FIG. 8). In the preferred embodiment illustrated in the drawings, as seen most clearly in FIGS. 2 and 6, the second manually activated adhesive pattern comprises a plurality of parallel, spaced strips/bands 36 of pressure sensitive adhesive, which cover a significant portion (typically at least about 40%) of the first envelope second face 19, and at least one release strip 37 covering the strips/bands 36. In the preferred embodiment according to the present invention, the strips/bands 36 are constructed with interspersed strips 38 of adhesive release material, and the at least one release strip 37 has on the bottom face thereof strips/bands of pressure sensitive adhesive 39 which intermesh with the strips/bands 36 and engage the release material 38, and strips of adhesive release material 40 intermeshing with the release material strips 38 and engaging the adhesive strips/bands 36. This type of general construction is shown in U.S. Pat. No. 5,336,541, the disclosure of which is hereby incorporated by reference herein.

Preferably the at least one strip 37 comprises a plurality of strips 37, more preferably four strips 37 as seen in FIG. 2. Each of the strips 37 preferably has indicia, such as colored stripes 42, and words 43—imaged on the top face thereof and each strip 37 is preferably dimensioned so that it fits on a side face of the box/package 35, as illustrated in FIG. 8. The strips 37 adhere to the cardboard or like material forming the box 35 because of the pressure sensitive adhesive strips/bands 39, and indicate clearly to an observer of the box 35 that the box 35 is to receive a particular type of handling and/or contains a particular type of materials. The adhesive strips/bands 36 (see FIG. 6 in particular) when pushed down into contact with the top face 44 of the box 35—as illustrated in FIG. 8—hold the envelope 11 firmly in place thereon. The adhesive of bands 36, 39 preferably is permanent adhesive.

The assembly 10 also preferably comprises indicia imaged at various locations aside from the indicia 43. For example destination indicia, e.g. for a gateway city, is shown at 46 in FIG. 2, and in simplified form at 46' in FIG. 5. The indicia 46, 46' is imaged on the second face 26 of the second envelope 12 and is visible at the same time as destination indicia—such as for the final destination city 47 (or shown in simplified form at 47' in FIG. 5)—once the filled envelopes 11, 12 are held in place with respect to each other by the adhesive 33, as seen in FIG. 5. Also various instructional indicia may be provided, such as detailed instructions 48 which also may be visible on the uncovered portion 31 of the first envelope 11, as well as other miscellaneous instructional indicia such as seen at 49 in FIG. 1. Also, instructional indicia 50 may be provided on the first face 25 of the second envelope 12 as seen in FIG. 1 indicating that a lot label or like identification mechanism should be affixed thereto (e.g. by a label adhesive).

The assembly 10 also preferably includes a continuous envelope flap, shown by reference numeral 52 in FIGS. 1 and 5 at the first sides 13, 21 of the envelopes 11, 12. A third manually activatable adhesive pattern, such as a pressure sensitive adhesive strip 53 covered by a release strip 54, or rewettable adhesive, may be provided on the flap 52 to allow sealing of the flap 52 to close the open first sides 13, 21 of the envelopes 11, 12. FIG. 5 shows the flap 52 sealed in place by the adhesive 53. The flap 52 may be separated from the bodies of the envelopes 11, 12 by a fold line or preferably a perforation or like line of weakness 55 (see FIG. 1).

FIG. 8 illustrates an exemplary package assembly according to the present invention. The box 35 earlier described preferably comprises a substantially rectangular parallelepiped box having six faces including a top face 44 and a bottom face (opposite the face 44) as well as four side faces 56, preferably a strip 37 being applied to each side face 56 (only two of which are shown in FIG. 8). The strips 37 are rectangular labels with alternating adhesive strips or bands 39 and release material 40.

Exemplary products according to the invention having been described, an exemplary manner of use will now be set forth.

Figure 4:
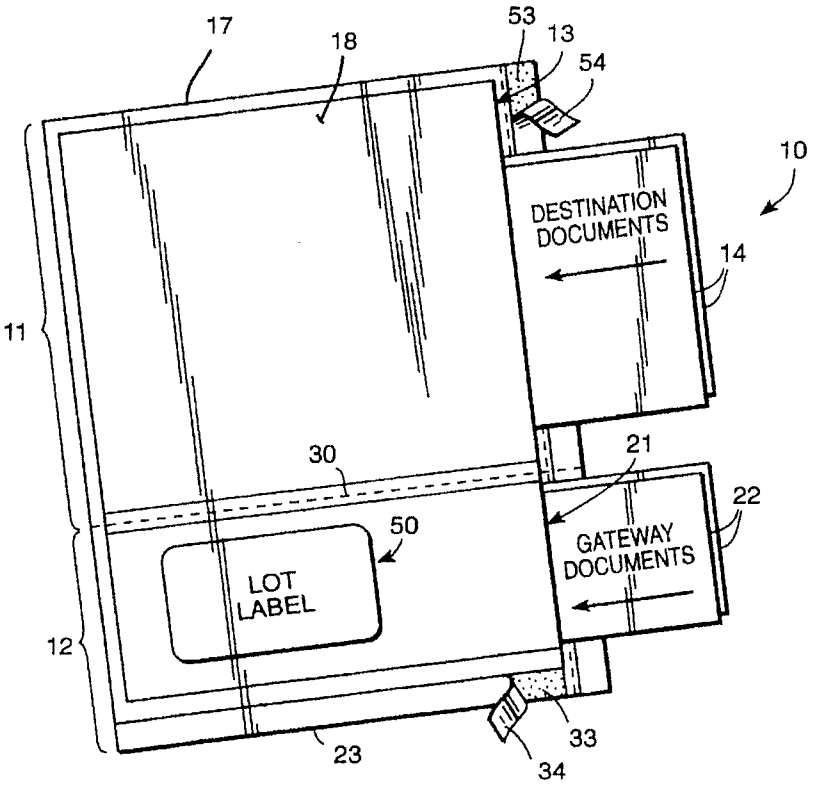
FIG. 4 is a top schematic perspective view showing the envelope assembly of FIGS. 1 through 3 with documents being inserted into the envelopes, and with release strips associated with the envelope flaps and the second envelope being removed.
Figure 6:
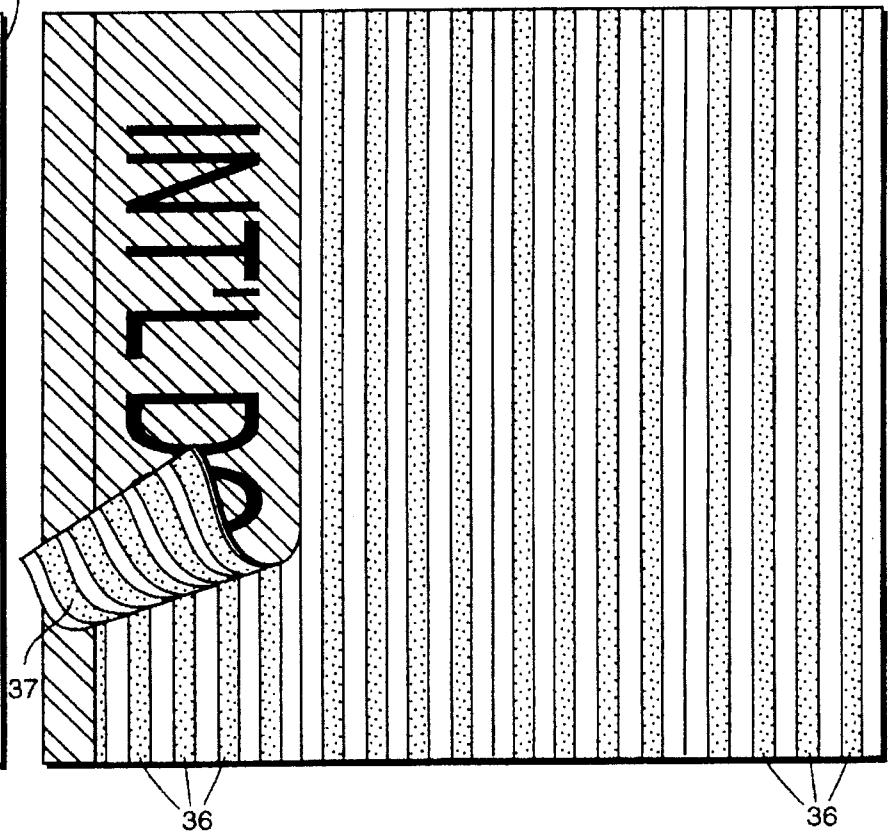
FIG. 6 is a bottom plan view of the envelope assembly of FIG. 5 showing three of the four separate strips covering the first envelope second face having been removed and the fourth being removed.

Destination documents 14 are inserted into the open side 13 of the first envelope 11 and destination documents 22 in the second envelope open side 21, as illustrated in FIG. 4. Then the release strip 54 is removed from the adhesive 53, and the flap 52 folded about the fold line/perforation line 55 to seal the open ends 13, 14 shut, as seen in FIGS. 5 and 6. A lot label is produced and placed over the indicia 50. Then the release strip 34 is removed, uncovering the adhesive 33, and the envelope 12 is folded about the perforation line 30 so that the first face 25 thereof comes in contact with the closest portion of the first face 18 of the first envelope 11, leaving the uncovered portion 31 (see FIG. 5), and the pressure sensitive adhesive 33 is sealed into place so that it holds the envelope 33 to the envelope 11 (see FIGS. 5 and 7). The gateway city information is filled in (e.g. with a marker) at the indicia 46' or 46, and the final destination city indicia also filled in with a marker or the like at the indicia 47' or 47. Then the strips 37 are removed from the second face 19 of the first envelope 11, and the adhesive strips 36 are placed on an appropriate surface.

One typical example of the surface on which the envelope assembly 10 with the strips 37 removed is placed is the top face 44 (see FIGS. 7 and 8) of the rectangular parallelepiped box 35. In that case the strips 37 are applied one each to the side faces 56 of the box 35, as seen in FIG. 8.

Figure 7:
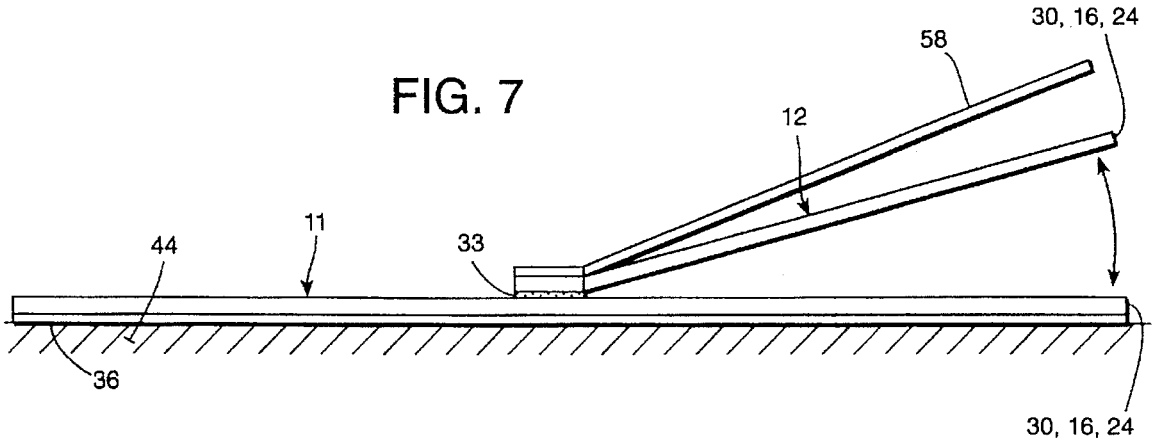
FIG. 7 is a side schematic view showing the envelope assembly of FIGS. 5 and 6 connected to a package and with the second envelope being separated from the first envelope.

When the gateway city is reached, the envelope 12 is separated from the envelope 11 along the perforation line 30 as seen schematically in FIG. 7, and the rest of the envelope 12 with the lot label covering the indicia 50 will separate from a backing portion 58, as also seen in FIG. 7, which is a continuation of the strips 37 and having alternate bands of adhesive and release material like those for the strips 57. The envelope 12 is opened up tearing along the perforation line 55, and the documents 22 removed. The envelope 11 is opened up, again preferably by tearing along the perforation line 55, at the final destination city, and the box 35 also opened thereat.

It will thus be seen that according to the present invention a simple yet effective shipping envelope assembly, and package assembly, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A shipping envelope assembly comprising:

a first envelope having a first, open side allowing insertion of documents therein, a second side substantially parallel to said first side, and third and fourth sides substantially perpendicular to said first and second sides, and first and second faces;

a second envelope having a first, open side allowing insertion of documents therein, a second side substantially parallel to said first side, and third and fourth sides substantially perpendicular to said first and second sides, and first and second faces;

said first and second envelopes having a connection along a cooperating side of each, connecting said envelopes together;

a line of weakness formed at said connection of said first and second envelopes;

a first manually activatable adhesive pattern provided on at least one of said first and second envelopes first face for securing said second envelope first face to said first envelope first face when said second envelope is folded with respect to said first envelope along said line of weakness; and a second manually activatable adhesive pattern provided on said second face of said first envelope for attachment of said first envelope to a package.

2. An assembly as recited in claim 1 wherein said cooperating sides of said first and second envelopes providing a connection therebetween comprises said third side of said first envelope and said fourth side of said second envelope; and wherein said first side of each of said envelopes are substantially aligned with each other.

3. An assembly as recited in claim 1 wherein said second manually activatable adhesive pattern comprises a first pressure sensitive adhesive coating covering a significant portion of said first envelope second face, and at least one release strip having first and second faces, and covering said first adhesive coating with said first face of said at least one release strip in contact with said second face of said first envelope.

4. An assembly as recited in claim 3 wherein said at least one release strip includes a second pressure sensitive adhesive coating covering a significant portion of said first face thereof, and further comprising indicia printed on said second face of said at least one release strip.

5. An assembly as recited in claim 4 wherein said second face of said first envelope and said first face of said at least one release strip comprise alternating and intermeshing bands of pressure sensitive adhesive and adhesive-release material.

6. An assembly as recited in claim 5 wherein said at least one release strip comprises a plurality of release strips each dimensioned to fit on a face of a package to which said first envelope second face is applied.

7. An assembly as recited in claim 6 wherein said first manually activatable adhesive pattern comprises a pattern of pressure sensitive adhesive disposed on said second envelope first face adjacent said third side of said second envelope, and covered by a release strip.

8. An assembly as recited in claim 7 further comprising destination indicia imaged on said second face of said second envelope.

9. An assembly as recited in claim 8 wherein said second envelope is dimensioned so that the distance between said third and fourth sides thereof is about 30–70% of the distance between said third and fourth sides of said first envelope, so that when said second envelope is folded about said line of weakness to bring said first pattern of adhesive into contact with said first face of said first envelope an uncovered portion of said first face of said first envelope is provided; and further comprising destination indicia imaged on said uncovered portion of said first face of said first envelope.

10. An assembly as recited in claim 2 further comprising a continuous envelope flap provided at said first side of each of said first and second envelopes, and a third manually activatable adhesive pattern formed on said flap to allow sealing of said flap to close said open first sides of said envelopes.

11. An assembly as recited in claim 2 wherein said first manually activatable adhesive pattern comprises a pattern of pressure sensitive adhesive disposed on said second envelope first face adjacent said third side of said second envelope, and covered by a release strip.

12. An assembly as recited in claim 2 further comprising destination indicia imaged on said second face of said second envelope.

13. An assembly as recited in claim 12 wherein said second envelope is dimensioned so that the distance between said third and fourth sides thereof is about 30–70% of the distance between said third and fourth sides of said first envelope, so that when said second envelope is folded about said line of weakness to bring said first pattern of adhesive into contact with said first face of said first envelope an uncovered portion of said first face of said first envelope is provided; and further comprising destination indicia imaged on said uncovered portion of said first face of said first envelope.

14. A shipping envelope assembly comprising:

a first envelope having a first, open side allowing insertion of documents therein, a second side substantially parallel to said first side, and third and fourth sides substantially perpendicular to said first and second sides, and first and second faces;

a second envelope having a first, open side allowing insertion of documents therein, a second side substantially parallel to said first side, and third and fourth sides substantially perpendicular to said first and second sides, and first and second faces;

said first and second envelopes having a connection along a cooperating side of each, connecting said envelopes together;

a first manually activatable adhesive pattern provided on at least one of said first and second envelopes first face for securing said second envelope first face to said first envelope first face when said second envelope is folded with respect to said first envelope along said line of weakness; and a second manually activatable adhesive pattern provided on said second face of said first envelope for attachment of said first envelope to a package; and wherein said cooperating sides of said first and second envelopes providing a connection therebetween comprises said third side of said first envelope and said fourth side of said second envelope; and wherein said first side of each of said envelopes are substantially aligned with each other.

15. An assembly as recited in claim 14 further comprising a continuous envelope flap provided at said first side of each of said first and second envelopes, and a third manually activatable adhesive pattern formed on said flap to allow sealing of said flap to close said open first sides of said envelopes.

16. An assembly as recited in claim 14 wherein said first manually activatable adhesive pattern comprises a pattern of pressure sensitive adhesive disposed on said second envelope first face adjacent said third side of said second envelope, and covered by a release strip.

17. An assembly as recited in claim 14 further comprising destination indicia imaged on said second face of said second envelope; and wherein said second envelope is dimensioned so that the distance between said third and fourth sides thereof is about 30–70% of the distance between said third and fourth sides of said first envelope, so that when said second envelope is folded about said line of weakness to bring said first pattern of adhesive into contact with said first face of said first envelope an uncovered portion of said first face of said first envelope is provided; and further comprising destination indicia imaged on said uncovered portion of said first face of said first envelope.

18. An assembly as recited in claim 14 wherein said second manually activatable adhesive pattern comprises a first pressure sensitive adhesive coating covering a significant portion of said first envelope second face, and at least one release strip having first and second faces, and covering said first adhesive coating with said first face of said at least one release strip in contact with said second face of said first envelope; and wherein said at least one release strip includes a second pressure sensitive adhesive coating covering a significant portion of said first face thereof; and further comprising indicia printed on said second face of said at least one release strip.

19. An assembly as recited in claim 18 wherein said second face of said first envelope and said first face of said at least one release strip comprise alternating and intermeshing bands of pressure sensitive adhesive and adhesive-release material; and wherein said at least one release strip comprises a plurality of release strips each dimensioned to fit on a face of a package to which said first envelope second face is applied.

20. A package assembly comprising:

a substantially rectangular parallelepiped box having six faces, including top and bottom faces and four side faces;

an envelope having a first face with destination indicia imaged thereon and a second face with alternating strips of pressure sensitive adhesive and release material, said second face pressure sensitive adhesive adhered to said top face of said box, and second envelope including documents therein; and four rectangular labels each having a first face with indicia imaged thereon and a second face with alternating strips of pressure sensitive adhesive and release material, said second face pressure sensitive adhesive of each of said labels adhered to one of said side faces of said box.

21. An assembly as recited in claim 20 wherein said envelope comprises a first envelope; and further comprising a second envelope smaller than said first envelope having first and second faces, said first and second envelopes connected together by a line of weakness at a common side edge thereof, and by adhesive at a position spaced from said common side edge so that said envelope first faces are in face-to-face engagement with each other and so that said destination indicia on said first envelope first face is uncovered by said second envelope; said second envelope containing documents therein.

22. An assembly as recited in claim 21 further comprising destination indicia imaged on said second envelope second face.

* * * * *